US011078705B2

(12) United States Patent
Salice

(10) Patent No.: US 11,078,705 B2
(45) Date of Patent: Aug. 3, 2021

(54) HINGE WITH OPENING DEVICE FOR PIECES OF FURNITURE

(71) Applicant: ARTURO SALICE S.P.A., Novedrate (IT)

(72) Inventor: Sergio Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 0 days.

(21) Appl. No.: 16/631,934

(22) PCT Filed: Jul. 26, 2018

(86) PCT No.: PCT/EP2018/070348

§ 371 (c)(1),
(2) Date: Jan. 17, 2020

(87) PCT Pub. No.: WO2019/025291

PCT Pub. Date: Feb. 7, 2019

(65) Prior Publication Data

US 2020/0173216 A1 Jun. 4, 2020

(30) Foreign Application Priority Data

Aug. 3, 2017 (IT) ..... 102017000089307

(51) Int. Cl.
*E05F 3/20* (2006.01)
*E05F 1/12* (2006.01)
*E05D 5/06* (2006.01)

(52) U.S. Cl.
CPC ..... *E05F 1/1246* (2013.01); *E05D 5/065* (2013.01); *E05Y 2201/604* (2013.01); *E05Y 2900/20* (2013.01)

(58) Field of Classification Search
CPC ..... E05D 11/087; E05D 3/142
See application file for complete search history.

(56) References Cited

U.S. PATENT DOCUMENTS 5,655,261 A * 8/1997 Cress ..... E05D 5/08 16/286
8,561,262 B1 * 10/2013 Liang ..... E05F 5/04 16/286

(Continued)

FOREIGN PATENT DOCUMENTS

CN 2527664 Y 1/2002
CN 201554316 * 8/2010

(Continued)

OTHER PUBLICATIONS

CN 201554316 Machine Translation, Chen, Paired hinge for door windows, 2010. (Year: 2010).*

(Continued)

*Primary Examiner* — Jason W San
(74) *Attorney, Agent, or Firm* — Scully, Scott, Murphy & Presser, P.C.

(57) ABSTRACT

A hinge for assembling a door on a piece of furniture comprises a first hinge element fastenable to a fixed part of the piece of furniture, a second hinge element fixable to a door of the piece of furniture and swingably connected to the first hinge element, and at least one spring element for generating a force in the opening direction for the door at least near the closing position of the door; the at least one spring opening element is housed in an opening device disposed in or on one of the first and second hinge elements, wherein the opening device is conformed and arranged for exerting said opening force directly or indirectly on the other of said first and second hinge elements.

15 Claims, 6 Drawing Sheets

(56) References Cited

U.S. PATENT DOCUMENTS 9,163,447 B1* 10/2015 Liang ..... E05F 3/20
9,169,681 B2* 10/2015 Cooper ..... E05F 5/006
10,081,975 B2* 9/2018 Cooper ..... E05F 5/02
10,214,951 B2* 2/2019 Liang ..... E05F 3/20
10,458,168 B2* 10/2019 Hammerer ..... E05D 11/1021
2005/0015927 A1 1/2005 Kropf
2011/0072617 A1* 3/2011 Lin ..... E05F 5/006 16/298
2011/0225768 A1* 9/2011 Haemmerle ..... E05D 3/16 16/49
2011/0291538 A1* 12/2011 Brunnmayr ..... E05F 5/006 312/326
2011/0298349 A1* 12/2011 Sutterlutti ..... E05F 5/006 312/326
2012/0060325 A1* 3/2012 Lin ..... E05D 11/084 16/327
2012/0174338 A1* 7/2012 Wu ..... E05F 5/006 16/297
2013/0019713 A1* 1/2013 Krudener ..... E05D 11/00 74/99 R
2013/0145580 A1* 6/2013 Brunnmayr ..... E05F 5/006 16/277
2013/0160242 A1* 6/2013 Brunnmayr ..... E05F 5/04 16/286
2013/0239363 A1* 9/2013 Apur ..... E05F 5/006 16/50
2014/0352111 A1* 12/2014 Ng ..... E05F 5/02 16/286
2014/0366322 A1* 12/2014 Salice ..... E05F 5/006 16/277
2015/0330128 A1* 11/2015 Ng ..... E05D 7/0407 16/65
2016/0138319 A1* 5/2016 Wu ..... E05D 7/0415 16/50
2016/0153224 A1* 6/2016 Salice ..... E05F 5/02 16/52
2016/0273258 A1* 9/2016 Pecar ..... E05F 5/02
2018/0135344 A1* 5/2018 Liang ..... E05D 3/142

FOREIGN PATENT DOCUMENTS

CN 201554316 U 8/2010
CN 101999026 A 3/2011
CN 102333930 A 1/2012
DE 202004019238 U1 2/2005
WO WO 2012/139789 A1 10/2012

OTHER PUBLICATIONS

International Search Report and Written Opinion dated Oct. 9, 2018 issued in PCT/EP2018/070348.
Italian Search Report dated Apr. 12, 2018 issued in IT 102017000089307, with partial translation.
Chinese Office Action dated Mar. 24, 2021 received in Chinese Application No. 201880038082.5.

* cited by examiner

HINGE WITH OPENING DEVICE FOR PIECES OF FURNITURE

The invention relates to a hinge with an opening device for doors of pieces of furniture or the like.

Pieces of furniture are often used in the interior decoration sector which have doors without handles or similar grip means; in this case, the doors are conventionally connected swingably to the body of the pieces of furniture by means of hinges which comprise a first hinge element which is fixed to the body of the piece of furniture, a second hinge element which is fixed to the door and is connected to the first one swingably by virtue of articulation means, and at least one spring which is mounted directly in the first element and acts on the articulation means in order to impose on said doors a movement in the opening direction at least near the closure position of the door. A hinge of this type is known for example from DE 10152699.

In order to arrest in a releasable manner the doors in the closure position, the piece of furniture furthermore has suitable engagement devices, which, as a consequence of a brief push on the closed door by the user, are released in order to allow the springs of the hinges to generate a movement of the door in the opening direction at least by a first extent which is sufficient for the user to grip it and then open it completely.

However, in known hinge solutions, the opening springs have a configuration that is optimized with reference to doors having specific weight and dimensions, but this configuration cannot be modified easily during construction since any small variation in shape thereof entails significant variations in the behavior of the hinge but most of all entails an unacceptable reduction of the life of the springs.

Therefore, if it is necessary to assemble doors with dimensions and weights that are different from the ones considered for the optimized configuration cited above, the springs may apply an opening force that is excessive with respect to the necessary one, with the risk that the engagement devices mentioned above might not always be capable of holding the doors arrested in the closed position.

The aim of the present invention is therefore to provide a hinge for doors of pieces of furniture or the like which has elastic opening means which can be adapted easily for use of the hinges on doors having different weight and dimension characteristics, maintaining in any case an effective elastic action for the opening of the doors and a high reliability of said hinges.

Within the scope of this aim, an object of the present invention is to provide a hinge for doors of pieces of furniture or the like, of the kind mentioned above, in which the elastic opening means can be adjusted simply even after the assembly of the hinges on the pieces of furniture.

This aim, as well as these and other objects which will become better apparent hereinafter, can be achieved by means of a hinge for assembling a door on a piece of furniture, comprising:

- a first hinge element fastenable to a fixed part of the piece of furniture;
- a second hinge element fixable to a door of the piece of furniture, the second hinge element being swingably connected to said first hinge element; and
- at least one spring element for generating a force in the opening direction of the door, characterized in that said at least one spring opening element is housed in an opening device disposed in or on one of said first and second hinge elements, and in that the opening device is conformed and arranged for exerting said opening force directly or indirectly on the other of said first and second hinge elements.

Further characteristics of the present invention are furthermore defined in the subsequent claims.

The characteristics and advantages of the present invention will become better apparent from the description that follows of some preferred but nonlimiting embodiments of the hinge with opening device for pieces of furniture, with reference to the accompanying figures, wherein:

FIGS. 1 to 6 show a hinge according to a first embodiment of the present invention, designated generally by the reference numeral 10, which is particularly suitable to be configured for an application to pieces of furniture of the American type, provided with a front frame on which the hinges are fixed.

This type of hinge 10 in general comprises a first hinge element or arm 11, formed by one or more parts, for the fixing of said hinge to a fixed part of the piece of furniture, in particular to the front frame, and a second hinge element or box 12 for fixing to a door of the piece of furniture.

Figure 1:
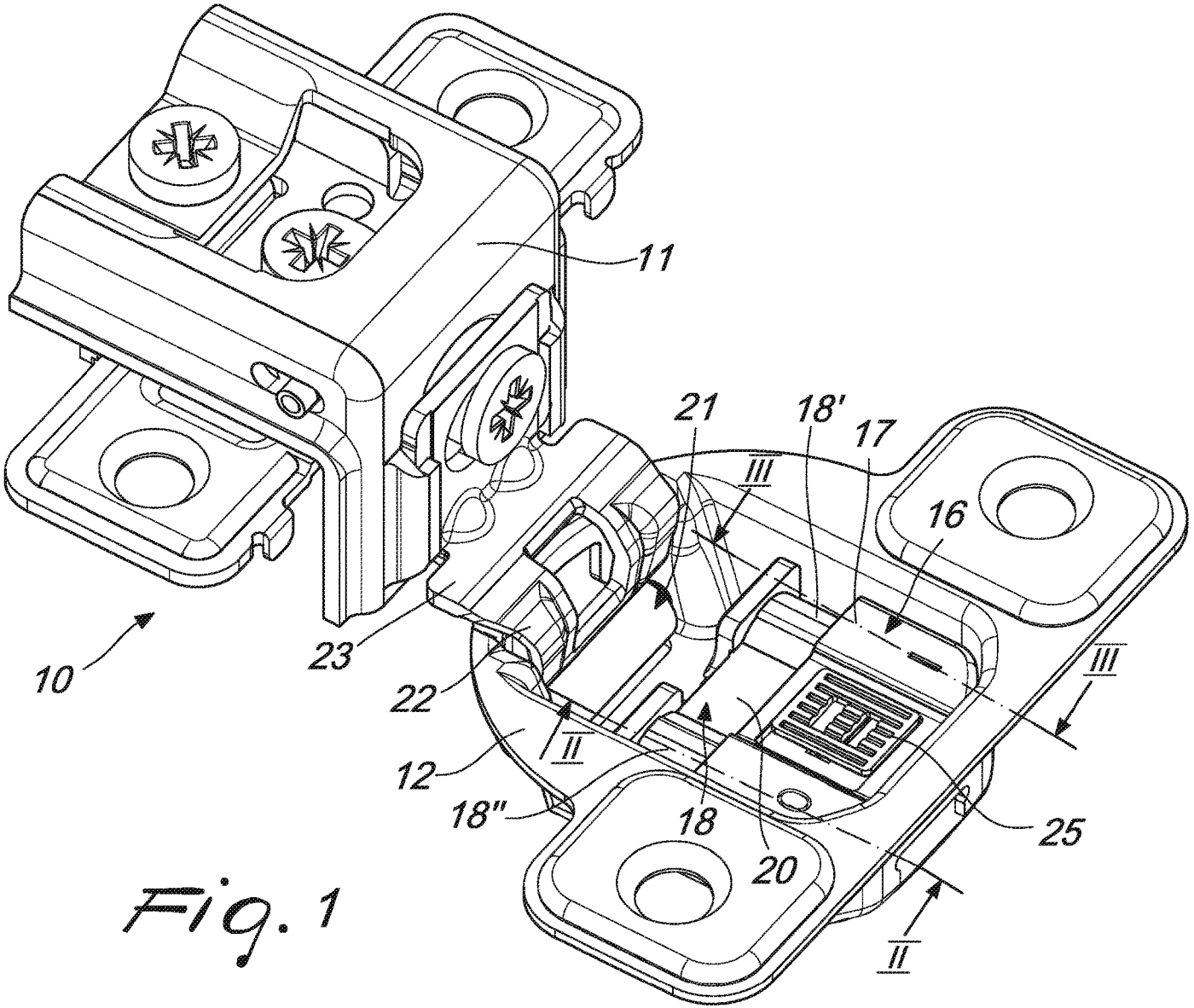
FIG. 1 is a perspective view of the hinge according to a first embodiment of the invention, in the open position, in which means for adjusting the opening device are provided which are arranged in the maximum opening force position.

The box 12 is connected swingably to the fixing arm 11 at a rear longitudinal end of said box 12, preferentially by means of a single oscillation pivot 13 which is extended transversely with respect to the longitudinal axis of the fixing arm 11, so that the box 12 can rotate between a closed position and an open position of the door shown in FIG. 1.

The box 12 of the hinge comprises a bottom wall 14 and side walls 15', 15" which are extended longitudinally on opposite sides of the box starting from the rear end.

The hinge 10 comprises furthermore an opening device 16 which is arranged inside the box 12 and comprises a retention or accommodation body 17 which can be fixed in the box 12 of the hinge at the front end thereof and a movable biasing member, for example conformed as a slider 18 which is arranged so that it can slide at least partially in the retention body 17 parallel to the bottom wall 14 of the box 12 or is arranged slidingly between the retention body 17 and the bottom wall 14 of the box 12.

The opening device 16 furthermore comprises at least one spring opening element 19, for example conformed as a helical spring, in order to generate a force in the opening direction of the door at least near the closure position, which is accommodated within the device itself, preferentially so that it is interposed between the body 17 and the slider 18.

The slider 18 is movable between a first contracted position at the closed position of the hinge, in which the elastic opening element 19 is compressed so that it can exert the opening force directly or indirectly on the first hinge element 11, and a second position that is at least partially extended, at the open position of the hinge, in which the elastic opening element 19 is at least partially released after it has exerted said opening force.

Preferentially, the slider 18 comprises a first hollow cylindrical part 18' and a second hollow cylindrical part 18" which are functionally connected to each other, for example by means of a transverse connecting element 20, and are extended so as to be parallel and mutually spaced in order to define respective housings for the at least one spring opening element 19; in particular, as a function of the opening force that must be applied, it is possible to provide for the insertion of a single spring 19 in one of the two hollow cylindrical parts 18', 18", or two springs 19, each in a respective cylindrical part, which have mutually identical or different force characteristics.

For the purposes of the transmission of the opening force from the opening device 16 to the hinge 11, the first and second cylindrical parts 18', 18" of the slider 18, at one end which protrudes from the retention body 17 in the direction of the rear end of the box 12, have respective closure walls provided with contoured surfaces or pusher cams 21 for corresponding contact surfaces 22 provided on the hinge arm 11; in particular, with reference to the preferential embodiment shown, the contact surfaces 22 are extended on folded sections of a front part 23 of the arm 11.

Preferentially, the contoured thrust surfaces 21 have an arc-like shape with the concavity directed toward the contact surfaces 22 of the hinge arm 11; by shaping appropriately said thrust surfaces 21 and in particular by modifying their curvature, it is possible to modulate the behavior of the opening force as a function of the opening angle of the hinge, adapting it as a function of the requirements and of the type of application of the hinge.

In order to guide the sliding of the slider 18, the cylindrical walls 18', 18" of the slider have lateral guiding extensions which are shaped and arranged so as to slide along the respective side walls 15', 15" of the box 12.

If a single spring 19 is provided in one of the cylindrical parts 18', 18", for the purposes of an improvement of the assembly of the opening device, in the other cylindrical part 18', 18" it is possible to provide a sliding element, not shown, which is connected to a stem which is extended in a guided manner through a lid for closing the cylindrical part 18', 18", said stem ending with a head which can be engaged with the retention body 17 of the device.

In order to allow simple and quick fixing of the opening device 16, the retention body 17 preferentially is provided with elastic lateral wings or other similar means which can be engaged by snap action at corresponding lateral openings of the box 12 of the hinge or vice versa.

The side walls 15', 15" of the box 12 preferentially have respective stroke limiting protrusions 24 for the slider 18 which extend into the box 12.

Figure 4:
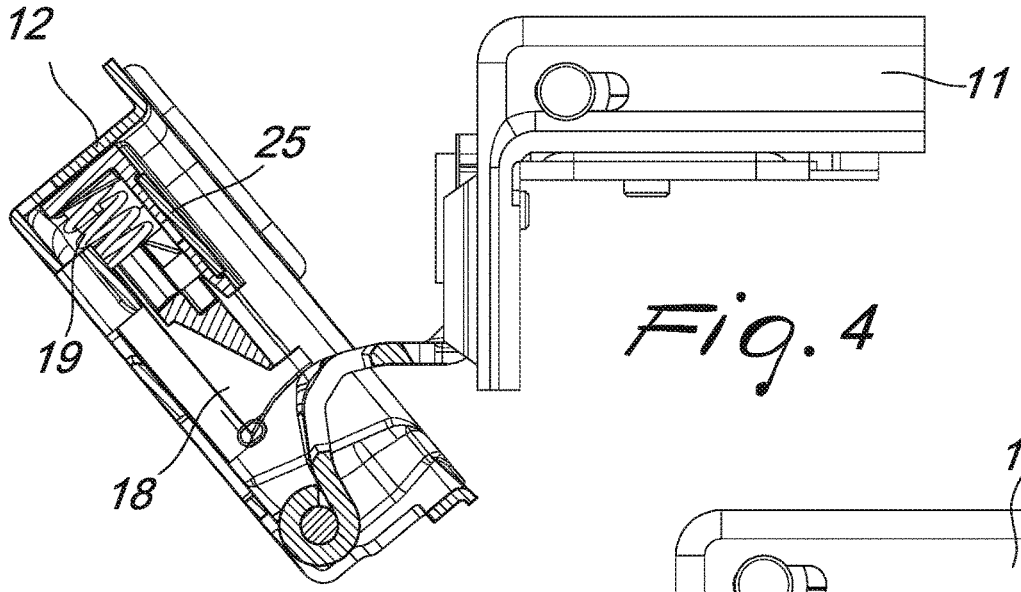
FIG. 4 is the sectional view of FIG. 2, in the angular position in which the opening action exerted by the opening device ends.

Starting from the closed position of the hinge, during the opening movement, the contoured surfaces 21 of the slider 18 remain in contact with the surfaces 22 of the arm of the hinge arm 11 to an opening angle of the hinge comprised for example between 30° and 40° as shown in FIG. 4; along said oscillation angle of the hinge, the slider 18 of the opening device, moving from the contracted position to the extended position, is capable of exerting its opening thrust on the part 23 of the hinge arm 11.

Preferentially, the hinge 10 comprises an adjustment or deactivation mechanism for adjusting or deactivating the opening device 16, so as to allow the assembly worker and/or the user of the piece of furniture to determine how many, among the hinges arranged on each door, are to be made to work in order to generate the opening force and/or how much opening force to obtain, in order to optimize the opening movement of the door as a function of the weight and dimensional characteristics of said door.

Figure 2:
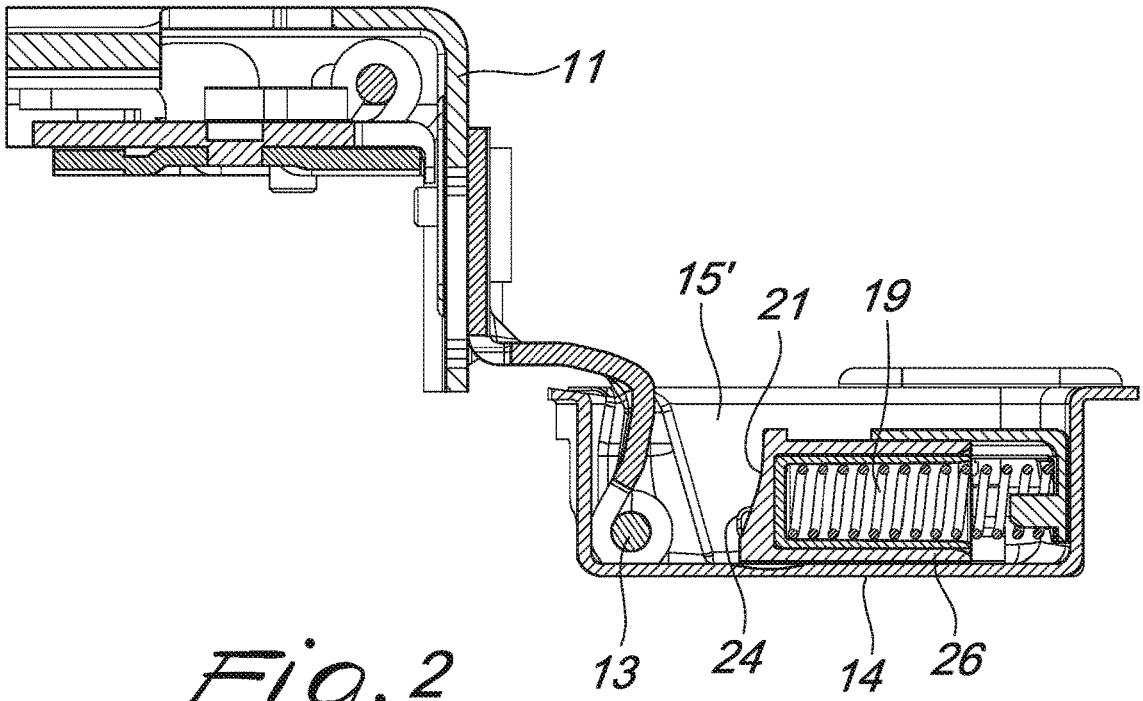
FIG. 2 is a longitudinal sectional view, taken along the plane 2-2 of the hinge of FIG. 1.
Figure 3:
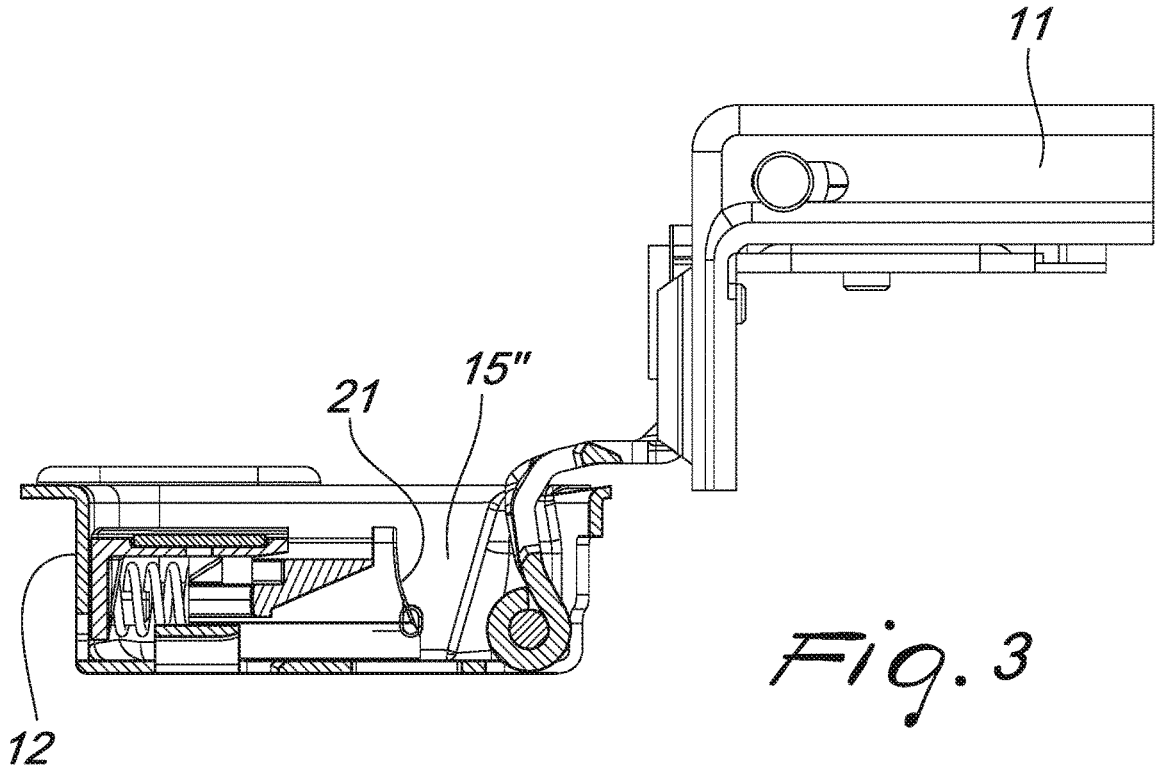
FIG. 3 is a longitudinal sectional view, taken along the plane 3-3 of the hinge of FIG. 1.
Figure 5:
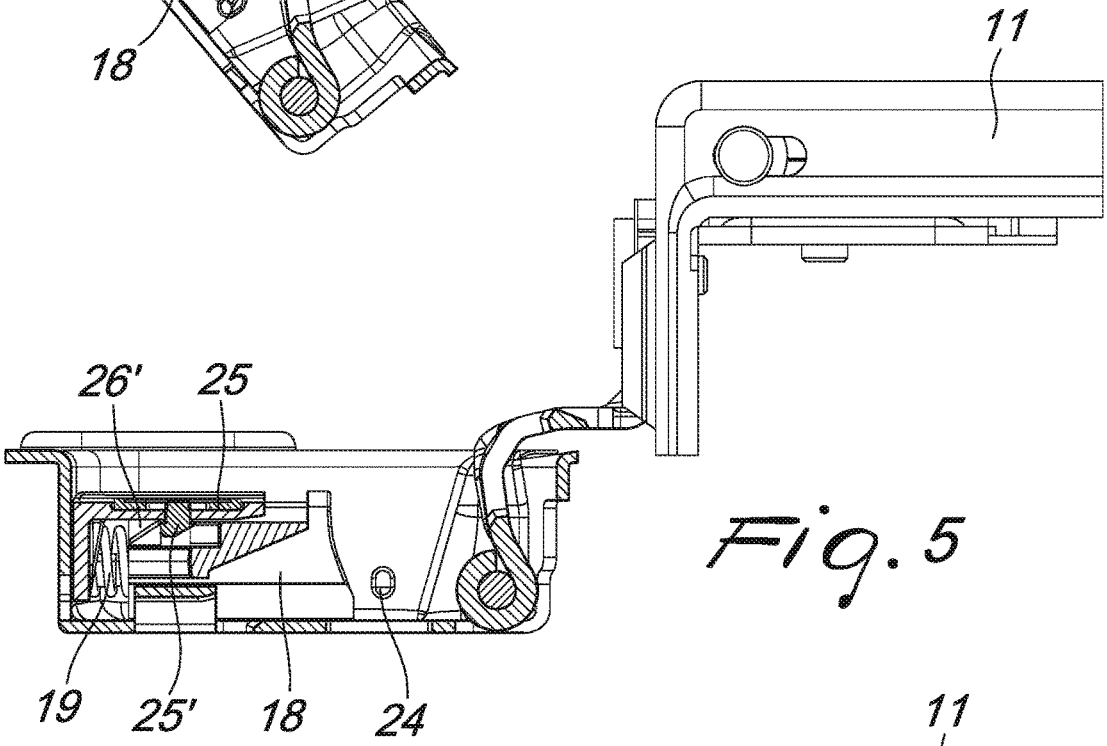
FIG. 5 is the sectional view of FIG. 2, in which the adjustment means of the opening device are arranged in a minimum opening force position, producing a contracted condition of said opening device.
Figure 6:
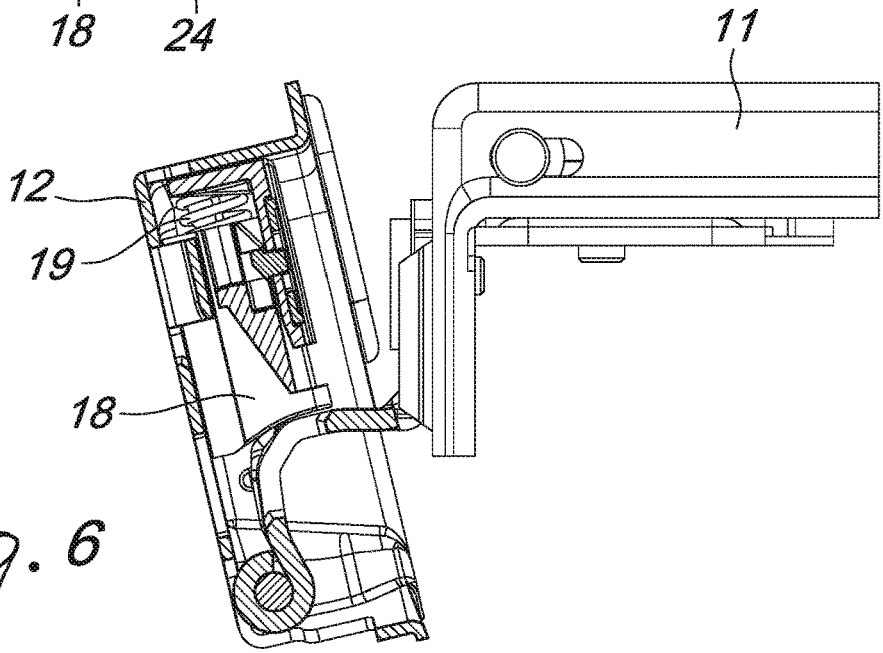
FIG. 6 is a sectional view of FIG. 5, in the angular position in which the opening action applied by the opening device ends.
Figure 7:
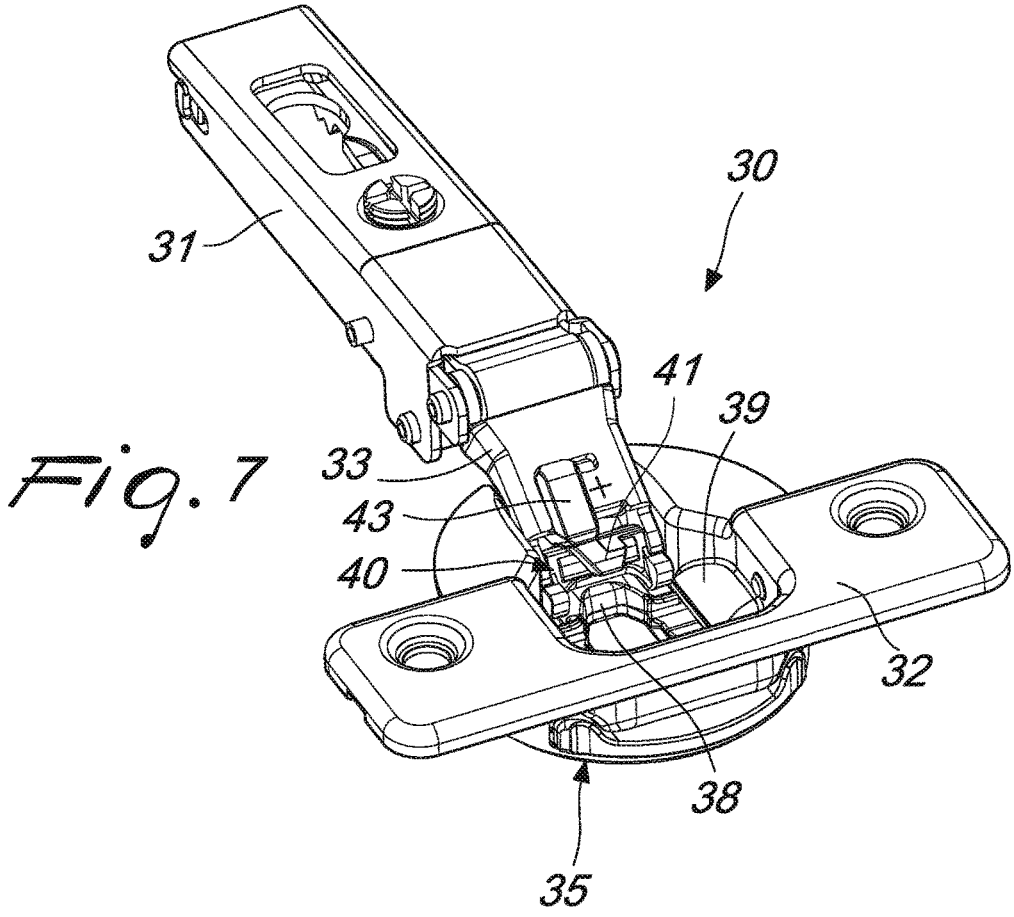
FIG. 7 is a perspective view of a second embodiment of the hinge according to the invention in the open position, in which means for adjusting the opening device are provided which are arranged in the maximum opening force position.
Figure 8:
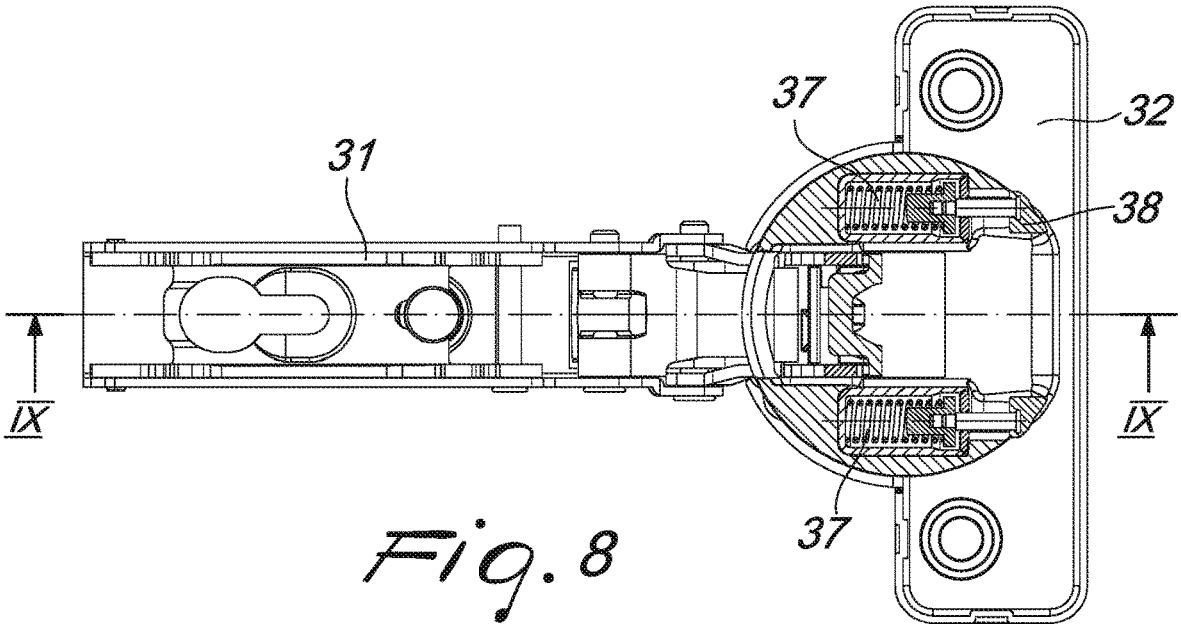
FIG. 8 is a sectional plan view of the hinge of FIG. 7.
Figure 9:
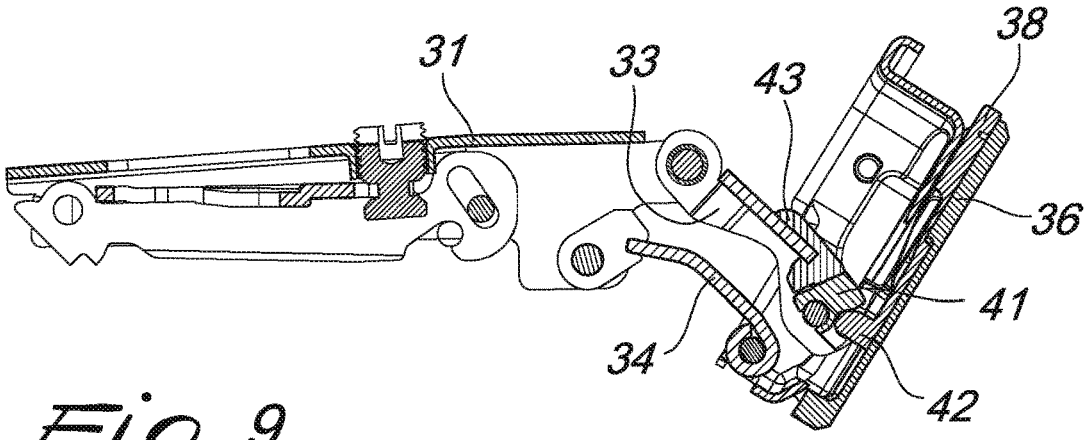
FIG. 9 is a longitudinal sectional view, taken along the plane 9-9, of the hinge of FIG. 8, in the angular position in which the opening action applied by the opening device ends.
Figure 10:
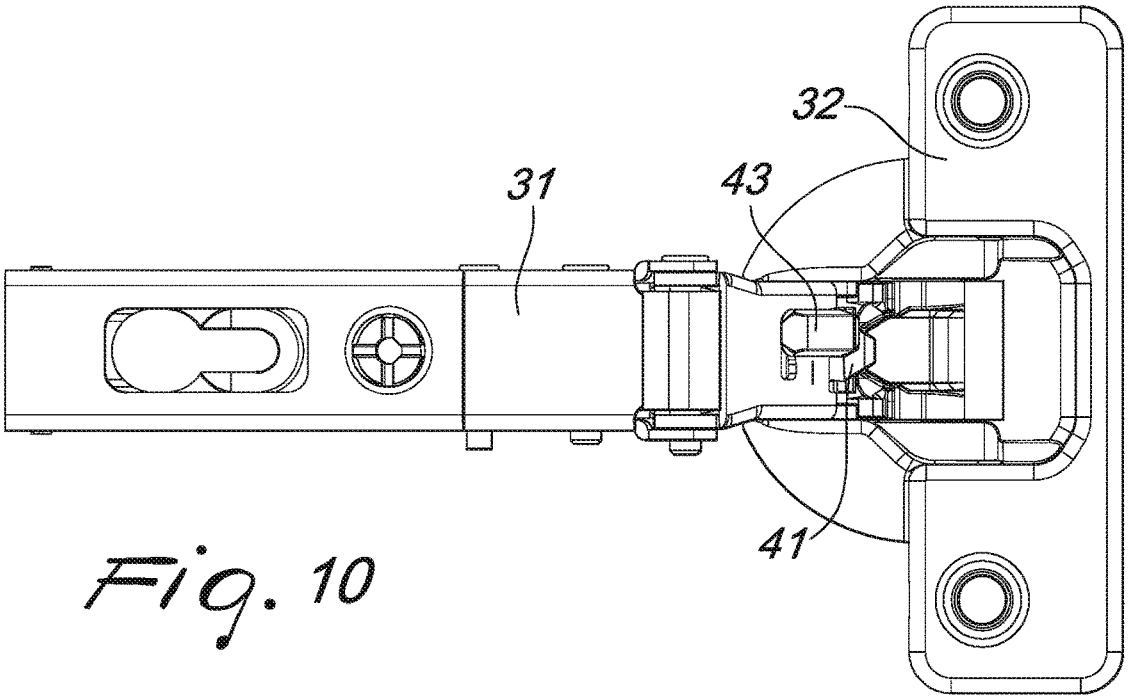
FIG. 10 is a plan view of the hinge of FIG. 7, in which the adjusting means of the opening device are arranged in a minimum opening force position.
Figure 11:
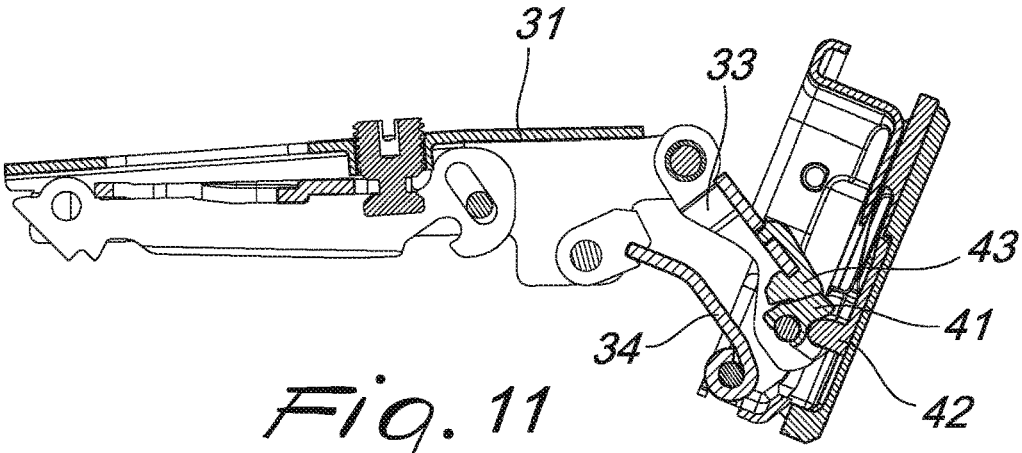
FIG. 11 is a longitudinal sectional view of the hinge of FIG. 10, in the angular position in which the opening action exerted by the opening device ends.

According to the exemplifying embodiment shown in FIGS. 1 to 6, this adjusting mechanism comprises an adjusting member 25 for the at least one elastic opening element 19, which can engage selectively the slider 18, directly or indirectly, and can move between a release position in which, with reference to FIGS. 1 to 3, the slider 18 can perform its entire stroke in order to apply the maximum opening force, and an arresting position in which, with reference to FIGS. 4 to 6, the slider 18 has a limited stroke, since by opening the hinge it is arrested in a position that is at least partially contracted, thus exerting only part of the opening force or not exerting it at all in case of arresting in the fully contracted position that corresponds to the closed position of the hinge.

The at least one opening spring 19 can be inserted in the respective hollow cylindrical part 18', 18" directly or by means of an intermediate retention element 26, which by interacting with the adjusting member 25 can allow to arrest or adjust indirectly but in a more versatile manner the opening device, in particular if there are two springs 19, allowing for example a separate adjustment of said springs 19.

In particular, preferentially the retention element 26 is a cup-shaped element in which the rear end of the opening spring 19 is inserted and has a lateral protrusion 26' which can be engaged by the adjusting member 25; furthermore, the cup-shaped retention element 26 is in turn inserted slidingly in at least one of the hollow cylindrical parts 18', 18" of the slider 18.

It is not excluded, in any case, that the retention element might have a different shape and/or arrangement, so long as it can retain the elastic opening means in a loaded condition.

Preferentially, the adjusting member 25 is conformed as a member that is supported so that it can move on the back of the housing body 17 and said element has a protruding part 25' which is extended through a through hole provided in the back of the housing body 17 in order to engage the lateral protrusion 26' of the cup-shaped retention element 26 so as to adjust or arrest the opening spring 19, as shown in FIG. 5.

Preferentially, the adjusting member 25 can move transversely with respect to the longitudinal direction of motion of the slider 18; it is not excluded, however, that the adjusting member might, as an alternative, be conformed as a member that is supported in a rotating or oscillating manner, with a part that is appropriately shaped and arranged in order to engage directly with the slider 18 or indirectly with the retention element, or conformed as a screw element.

In any case, in general, the adjusting member and the parts of the opening device that interact with it can be configured for a discontinuous adjustment of the opening device, as in the case described above, or for continuous adjustment, for example by providing appropriate inclined planes or actuation cams on the adjusting member or on the parts of the opening device that interact with it.

Furthermore, the adjusting member 25 is provided with grip or actuation means which can be actuated manually or by means of a tool, for example in the form of a knurling or a grip scoring.

The operation of the hinge 10 is as follows: when maximum opening force is required during the opening movement of the hinge, the adjusting member 25 must be arranged in the release position shown in FIGS. 1 to 3, so that the slider 18 and/or the retention element 26 can move freely longitudinally under the action of the at least one opening spring 19, thus biasing the hinge in the opening direction along a maximum oscillation arc starting from the closure position.

If instead there is the need to adjust or deactivate the opening device 16 of a hinge 10, for example to reduce the opening force in the case of small doors or low-weight doors, the user, while the hinge is open, must move the adjusting member 25 transversely in order to move it to an adjustment or arresting position in which the protruding part 25', which is extended below the adjusting member 25, lies on the trajectory of longitudinal motion of the lateral protrusion 26' of the retention element 26 or of a part of the slider 18 in case of direct adjustment without an intermediate retention element 26.

By performing now a first closure movement of the hinge 10, the front part 23 of the arm 11 pushes the slider 18, together with the retention element 26, until it causes the engagement of the lateral protrusion 26' of the retention element 26 with the protruding part 25' of the adjusting member 25 at the contracted position of said slider 24.

This engagement occurs by virtue of the elasticity and/or guiding surfaces provided on the parts, which facilitate the passing and the mutual engagement between the protrusion 26' of the retention element 26 with the protruding part 25' of the adjusting member 25.

In this engagement condition, the retention element 26 retains the opening spring 19 in a condition that is at least partially loaded, preventing the complete extension of the slider 18 and thus reducing the opening force exerted by the hinge.

Finally, if there is the need to reactivate the opening device 16, the user must move the adjusting member 25 transversely to move it to the release position, so as to free the retention element 26 and/or the slider 18 and thus allow the opening spring 19 to bias the slider 18 to the extended position when the door is opened.

As an alternative to the above cited means for adjusting the stroke of the slider, the adjustment mechanism can provide adjustable means for the pretensioning of the at least one elastic opening element, for example conformed as adjustment screws or wedge elements or eccentric elements or shims which can be adjusted and are shaped and arranged so as to compress more or release said elastic element, for example by acting on the ends of the elastic element, especially if the latter is in the form of a helical spring.

Also as an alternative, the adjustment mechanism can provide means for varying the fixing position of the opening device with respect to the first or second hinge element; in the case of the hinge of FIG. 1, the opening device can, for example, be fixed inside the box 12 in different predefined positions or the housing body 17, appropriately sized and configured, can be fixed to the box 12 by means of an eccentric element or other adjustment means so as to be able to vary continuously or discontinuously the fixing position of said device inside the box 12.

FIGS. 7 to 11 show a second embodiment of the hinge according to the invention, designated generally by the reference numeral 30, which comprises a hinge arm 31 which can be fixed to a fixed part of the piece of furniture, a hinge box 32 which can be fixed to a door of the piece of furniture and is connected swingably to the hinge arm 31 by means of at least one oscillation pivot or an articulation system which comprises a first oscillating connecting rocker 33 and a second oscillating connecting rocker 34 in order to be movable between a closed position and an open position of the hinge.

The hinge furthermore comprises an opening device 35 in order to cause a relative opening motion between the arm 31 and the box 32 of the hinge, which is arranged preferentially on an external side of the side walls and/or bottom walls of the hinge box 32; in any case, it is not excluded that it might be positioned inside the hinge box 32.

The opening device 35 comprises an accommodation body 36 for at least one spring opening element 37, preferentially two spring elements 37, and a movable biasing member 38, preferentially conformed as a slider which can move parallel to the bottom of the box 32, in which the at least one elastic element 37 is interposed between the body 36 and the biasing member 38.

Preferentially, the spring opening elements 37 are arranged at the edges between the side walls and the bottom of the box 32, for example partially inserted in seats 39 of the box 32 provided at said edges.

Furthermore, there is a transmission mechanism 40 between the opening device 35 and the hinge arm 31 or one of the connecting rockers 33, 34; in particular, the transmission mechanism 40 preferentially comprises a transmission cam 41 which is connected to the first rocker 33 and can be actuated by an element 42 for actuating the biasing slider 38 so as to transmit the opening force of the spring members 37 to said rocker 33, causing an opening motion of the hinge starting from the closed position to an opening angle for example comprised between 30° and 40°.

Preferentially, the hinge comprises an adjustment mechanism for the opening device 35 in order to adjust or deactivate at least partially the effect of said device; in the adjusting mechanism of the exemplifying embodiment shown in FIGS. 7 to 11, the transmission cam 41 is not mounted integrally with the rocker 33 of the hinge but is supported so that it can move with respect to the rocker 33, preferentially swingably about the rotation axis of the rocker with respect to the box 32.

Furthermore, the adjustment mechanism comprises a locking element 43 for the cam 41, which is supported so that it can move on the rocker 33, preferentially so that it can slide in a transverse direction, but other sliding directions or other types of motion, for example rotary motion, are not excluded, in order to be moved between a first activation position (FIG. 7), in which the cam 41 is rendered integral in motion with the rocker 33, allowing the opening device to apply the maximum opening force, and a second adjustment or deactivation position (FIG. 10), in which the cam 41 can oscillate to a certain extent with respect to the rocker 33, so that the opening device is capable of applying a reduced or nil opening force as a function of the oscillation allowed to the cam 41 on the rocker 33.

In particular, in the second deactivation position, the cam 41, in the portion in which it can oscillate freely, is unable to transmit to the rocker 33 any movement and actuates only a partial movement of the biasing member 38, thus adjusting completely or partially the opening force.

It is not excluded that the arresting element 43 and correspondingly the cam 41 can also have positions that are intermediate between the first activation position and the second deactivation position of the opening force, so as to obtain different degrees of opening force for the hinge.

In one possible variation of this embodiment, for example, the opening device can be arranged externally or internally on at least one side wall of the hinge box and the opening device can comprise an elastic element, preferentially a spiral spring or torsion spring, which is shaped so as to act on a biasing member, preferentially of the rotating type, which is extended inside the box. The biasing member acts on one of the rockers and/or on the hinge arm by means of a transmission mechanism which comprises preferentially an oscillating transition element which is arranged in the box and is shaped so as to make contact with the first rocker.

Furthermore, there is an adjusting mechanism for the opening device, for example comprising an adjusting or arresting member, preferentially conformed as an element which is arranged so that it can slide or rotate on the box and is shaped so as to stop in different angular positions the oscillating transmission element inside the box.

Figure 12:
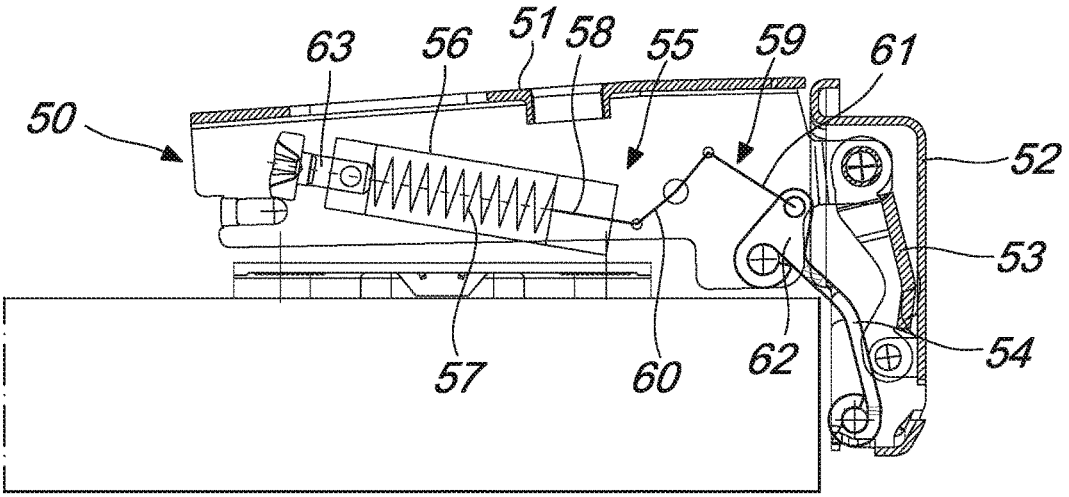
FIG. 12 is a longitudinal sectional view of a third embodiment of the hinge according to the invention, in the closed position, in which means for adjusting the opening device in a minimum opening force position are provided.
Figure 13:
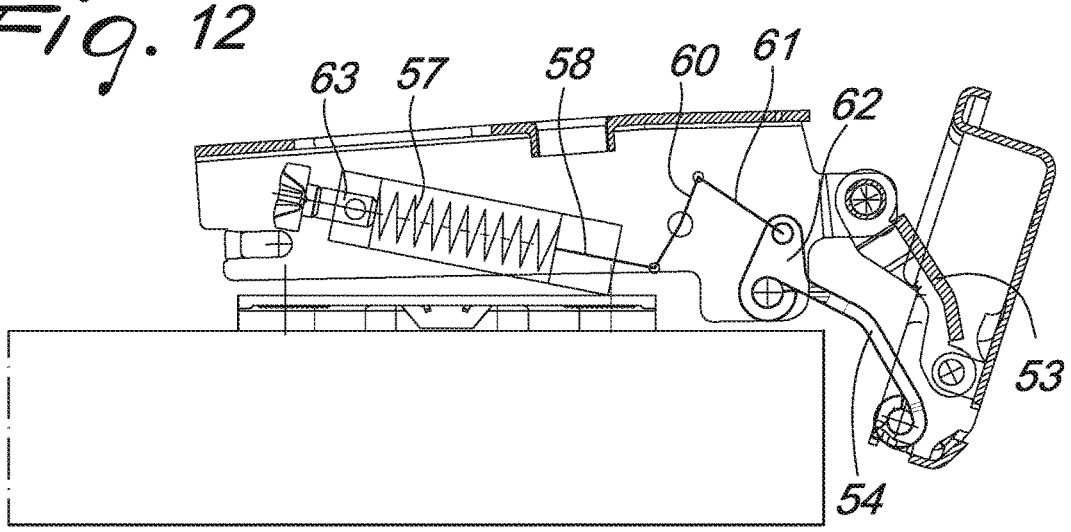
FIG. 13 is view of the hinge of FIG. 12, in the angular position in which the opening action exerted by the opening device ends.
Figure 14:
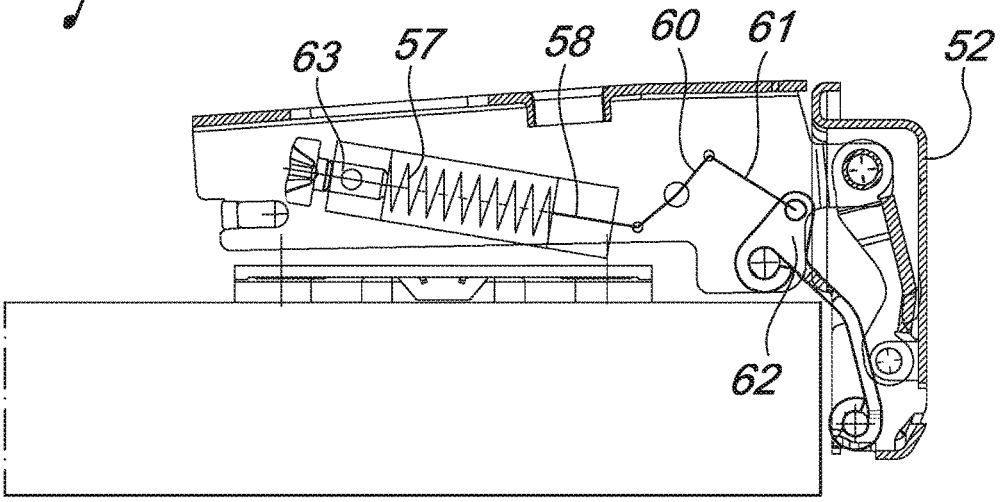
FIG. 14 is a view of the hinge of FIG. 12 in the closed position, in which the adjustment means of the opening device are in a maximum opening force position.

FIGS. 12 to 14 show a third embodiment of the hinge according to the invention, designated generally by the reference numeral 50, which comprises a hinge arm 51 which can be fixed to a fixed part of the piece of furniture, a hinge box 52 which can be fixed to a door of the piece of furniture and is connected swingably to the hinge arm 51 by means of at least one oscillation pivot or, as in the illustrated case, an articulation system which comprises a first oscillating connecting rocker 53 and a second oscillating connecting rocker 54 in order to be movable between a closed position and an open position of the hinge.

The hinge furthermore comprises an opening device 55 in order to cause a relative opening movement between the arm 51 and the hinge box 52, which is arranged preferentially inside the hinge arm 51; it is not excluded, in any case, that it might be arranged outside the hinge arm 51.

The opening device 55 comprises a housing body 56, for example conformed as a cylinder, for at least one spring opening element 57, and a movable biasing member 58, preferentially conformed as a stem with a presser for biasing the spring member 57.

Furthermore, there is a mechanism 59 for transmission between the opening device 55 and the hinge box 52 or one of the connecting rockers 53, 54; in particular, the transmission mechanism 59 preferentially is conformed as a transmission linkage which comprises a lever 60, connected at one end to the biasing member 58 and oscillating about a central axis, and a linkage 61, which is connected to the oscillating lever 60 and to an arm 62 of the second rocker 54, so as to transmit the opening force of the spring element 57 to said rocker 54, causing an opening movement of the hinge starting from the closure position up to an opening angle comprised for example between 20° and 40°.

Preferentially, the hinge comprises an adjustment mechanism for the opening device 55 in order to adjust or deactivate at least partially the effect of said device; in the adjustment mechanism of the exemplifying embodiment shown in FIGS. 12 to 14, an adjustment screw 63 engages at one end of the cylinder 56 so as to be able to compress or release the spring element 57, obtaining an increased or reduced opening force.

As an alternative to the adjustment screw it is possible to provide other adjustment means, for example an eccentric element or a slider which are shaped so as to act on the spring element, or it is possible to adjust the position of the opening device 55, for example of the housing cylinder 56 of the spring element 57.

The hinge according to the invention is susceptible of numerous modifications and variations, all of which are within the scope of the accompanying claims; the constructive details may furthermore be replaced with technically equivalent elements.

The disclosures in Italian Patent Application No. 102017000089307 from which this application claims priority are incorporated herein by reference.

The invention claimed is:

1. A hinge for assembling a door on a piece of furniture, comprising:

a first hinge element fastenable to a fixed part of the piece of furniture;

a second hinge element fixable to a door of the piece of furniture, the second hinge element being swingably connected to said first hinge element; and at least one spring element configured to generate an opening force in the opening direction of the door at least near a closing position of the door, wherein said at least one spring opening element is housed in an opening device disposed in or on one of said first and second hinge elements, the opening device, the opening device configured to exert said opening force directly or indirectly on the other of said first and second hinge elements, wherein the opening device comprises a body fixable to one of said first and second hinge elements, and a movable biasing member for the other of said first and second hinge elements, said at least one spring opening element being interposed between said body and said movable biasing member, and an adjusting mechanism configured to adjust the opening force of said opening device.

2. The hinge according to claim 1, wherein said opening device is disposed in said second hinge element fixable to the door.

3. The hinge according to claim 1, wherein said opening device is arranged on a side of said second hinge element fixable to the door.

4. The hinge according to claim 1, wherein said opening device is arranged in said first hinge element fixable to the fixed part of the piece of furniture.

5. The hinge according to claim 1, wherein said movable biasing member has a thrust surface for contacting said first or said second hinge elements or a connecting part between said first and second hinge elements.

6. The hinge according to claim 1, wherein said movable biasing member is operatively connected with said first or said second hinge elements or with a part for connection between them through a transmission mechanism.

7. The hinge according to claim 1, wherein said adjusting mechanism for said opening device comprises means for adjusting the stroke of said movable biasing member with respect to said body of the opening device.

8. The hinge according to claim 1, wherein said adjusting mechanism for said opening device comprises adjustable means for pretensioning said at least one spring element.

9. The hinge according to claim 1, wherein said adjusting mechanism for said opening device comprises means for changing the position in which said opening device is fixed with respect to said first or said second hinge element.

10. The hinge according to claim 1, wherein said adjusting mechanism comprises an adjusting member directly or indirectly engageable with said movable biasing member.

11. The hinge according to claim 10, wherein the adjusting member is conformed as an element movably supported on the housing body, said adjusting member having a protruding part which extends across a through hole in the housing body for engaging directly or indirectly with said movable biasing member.

12. The hinge according to claim 6, wherein the transmission mechanism comprises at least a first and a second connecting rockers, one of said rockers being provided with a transmission cam actuatable by said movable biasing member, wherein the adjusting mechanism provides that said transmission cam is movably supported with respect to the rocker, and comprises an arresting element for the cam, movably supported on the rocker.

13. The hinge according to claim 1, wherein said adjusting mechanism is configured for continuous adjustment of said opening device.

14. The hinge according to claim 1, wherein said adjusting mechanism is configured for discontinuous adjustment of said opening device.

15. The hinge according to claim 10, wherein said adjusting member is conformed as a slidable slider, a rotatable element, a rocking element or a screw element.

* * * * *